United States Patent [19]

McQueen

[11] 4,440,062

[45] Apr. 3, 1984

[54] REVERSIBLE BOLT FOR FIREARMS

[76] Inventor: Sidney J. McQueen, 414 Coors, S.W., Albuquerque, N. Mex. 87105

[21] Appl. No.: 290,857

[22] Filed: Aug. 7, 1981

[51] Int. Cl.[3] ..... F41C 5/06; F41C 11/00

[52] U.S. Cl. ..... 89/128; 89/4.5; 89/197

[58] Field of Search ..... 89/29, 128, 194, 197, 89/4 R, 4.5, 27 D; 42/9, 77

[56] References Cited

U.S. PATENT DOCUMENTS

| | | | |
|---|---|---|---|
| 3,287,843 | 11/1966 | Seidel | 42/16 X |
| 3,791,060 | 2/1974 | Weaver | 42/16 |
| 3,791,256 | 2/1974 | Curtis | 89/185 |
| 4,098,016 | 7/1978 | Foote | 42/16 |
| 4,169,329 | 10/1979 | Atchisson | 42/16 |

*Primary Examiner*—Donald G. Kelly

*Attorney, Agent, or Firm*—Walter R. Keller

[57] ABSTRACT

A reversible front bolt for converting a firearm of a first caliber to fire cartridges of a second caliber; or to provide a second front bolt of the same caliber as a spare part. The regular bolt assembly comprises a front bolt, a plurality of rails and a rear bolt, wherein the rails connect, and rigidly position the front bolt with respect to the rear bolt. The front bolt has two firing faces, and to change from one firing face to the other, the rails are disconnected from the front bolt, the front bolt reversed and the rails reconnected to the front bolt.

3 Claims, 4 Drawing Figures

REVERSIBLE BOLT FOR FIREARMS

SUMMARY OF THE INVENTION

This invention pertains to a firearm having a two piece bolt. In such weapons the portion of the bolt containing the firing pin, extractor, and cocking lever is herein designated the front bolt. The portion of the bolt containing the balancing mass and sear engagement means is designated the rear bolt. The rear bolt and the front bolt are connected by rails; and it is immaterial to this invention whether the rear bolt is towards the rear of the weapon with respect to the front bolt, or the rear bolt is in fact forward of the front bolt as perhaps surrounding the barrel. The front bolt is connected to the rear bolt by rails; the rails attach to the front bolt by pins in such a manner that the front bolt can be disengaged from the rails, then the front bolt can be reversed end for end and reattached to the rails. Each end of the front bolt can be of a different caliber to facilitate a change in weapon calibers, or of the same caliber to provide a spare front bolt. The invention facilitates easy in-field reconfiguration of the weapon to a different caliber or provides a means for a spare part without additional weight or the necessity of a second separate item to be carried. This invention provides a combatant the capability of using the ammunition of the foe should the combatant exhaust his own ammunition. Usually the caliber of ammunition used by a foe is known and can be anticipated. Therefore, a small amount of planning will enable the combatant to be equipped with the necessary parts to reconfigure his weapon to the caliber of ammunition used by his foe.

BACKGROUND

1. Field of the Invention

This invention relates generally to firearms, and more particularly to hand held firearms such as machine guns, submachine guns, machine pistols, and rifles.

2. Description of the Prior Art

Usually a weapon of one caliber cannot readily be converted to a weapon of another caliber; and spare parts for a particular weapon are in reality too bulky and heavy to carry in the field. However, conversion of a weapon from one caliber to another is often accomplished by substitution of parts as in Atchisson, U.S. Pat. No. 4,169,329 which converts an M-16 rifle from one caliber to another. Seidel, et al, U.S. Pat. No. 3,287,843 provides a displaceably supported breach carrier with a breach bolt connected to it, guiding a striker pin for converting to a different caliber. The device of the present invention provides the required alternative configuration of the bolt, or a replacement bolt in an already required part, therefore there is no substantial weight increase. It is acknowledged that to convert a weapon from one caliber to another, other parts such as the barrel and ammunition magazine receiver must also be changed to accomplish a complete conversion.

DESCRIPTION OF THE PREFERRED EMBODIMENT

Figure 1:
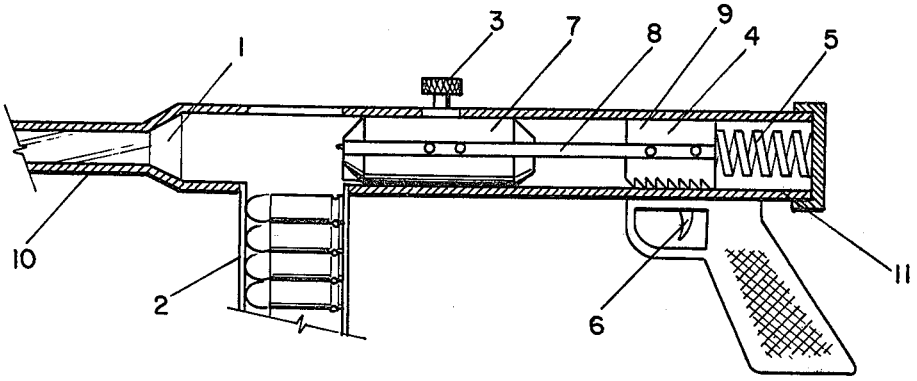
FIG. 1 is cross sectional view of a typical weapon.
Figure 2:
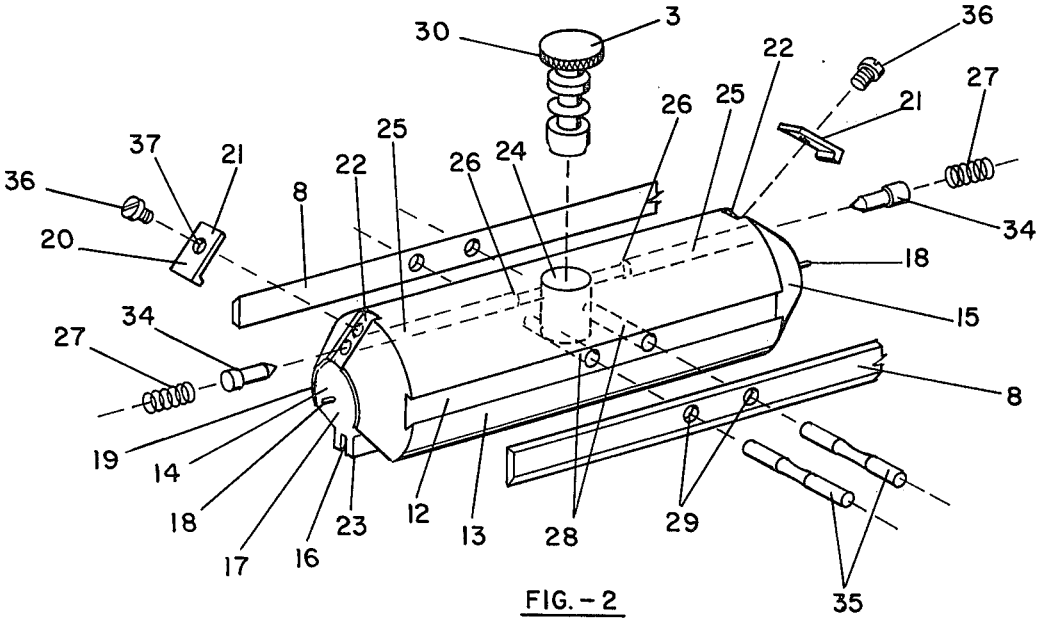
FIG. 2 is an exploded isometric view of the front bolt.

Referring to the drawings, FIG. 1 illustrates a basic configuration of a weapon having a chamber 1, a magazine 2, a cocking lever 3, a bolt 4, a recoil spring 5, a trigger assembly 6, a barrel 10, and a housing 11. Also shown in FIG. 1 is the bolt 4 being comprised of a front bolt 7, two side rails 8, and a rear bolt 9. In various weapons, the rear bolt 9 may be forward of the chamber 1 surrounding the barrel 10. The side rails 8 connect the front bolt 7 to the rear bolt 9 and the bolt 4 is supported in the weapon housing 11 by the side rails 8 or the rear bolt 9 so that the front bolt 7 is cantilevered in position and the front bolt 7 is thereby totally supported without contact to other parts of the weapon. The front bolt 7 is shown in FIG. 2 to have an essentially cylindrical center section 13, a first caliber section 14, and a second caliber section 15. The cylindrical center section 13, the first caliber section 14, and the second caliber section 15 are all integrally made. The cylindrical center section 13 is shown to have two rail grooves 12 along its length, said rail grooves 12 being approximately diametrically disposed about the cylindrical center section 13. The rail grooves 12 are shown as dovetail in cross section, however any convenient and economical cross section which provides the required rigidity and proper positioning of the front bolt 7 is contemplated. Indeed, even the rail grooves 12 could be replaced with bores, and the side rails 8 could be rods instead of being essentially as shown. The side rails 8 are shaped to mate with the rail grooves 12 in a manner that the side rails 8 are removable but are rigidly attachable to the front bolt 7. An ejector groove 16 is machined in the bottom of, and along the entire length of, the front bolt 7. The ejector groove 16 is shaped to accomodate a standing ejector, not shown. The first caliber section 14 is essentially a truncated right cone in shape, having a firing face 17 and a fixed firing pin 18. The firing face 17 has a cartridge holding rim 19 around most of its circumference, and the fixed firing pin 18 is in the center of the firing face 17. Along the top of the first caliber section 14 is an extractor mechanism 20. The extractor mechanism 20 consists of an extractor 21, which slides in an extractor groove 22 machined in the top of the first caliber section 14. The extractor 21 is biased toward the fixed firing pin 8 by an extractor spring 41 in an extractor spring slot 42 machined in the bottom of the extractor groove 22. The extractor 21 is retained in the extractor groove 22 by the edges of the extractor groove 22 which is dovetail in cross section and by a retaining screw 36 which is screwed through a screw hole 43 in the extractor 21 and which protrudes into the extractor spring slot 42. The extractor spring slot 42 is longitudinal in the bottom of the extractor groove 22, but the extractor spring slot 42 has ends so that the extractor 21 is precluded from coming out of the extractor groove 22. The extractor spring 41 is a coil spring around the shank of a small piston 44, which acts on the protruding end of the retaining screw 36 thereby biasing the extractor 21. The length of the first caliber section 14, and the size of the firing face 17, the size of the cartridge holding rim 19, and the size and length of the fixed firing pin 18 are all determined by the design caliber of ammunition.

The ejector groove 16 is formed by two ejector groove walls 23. The ejector groove walls 23 are curved on the edges, and sized to that the ejector groove walls 23 will slide inside the ammunition magazine 2; thus the ejector groove walls 23 force the ammunition into the chamber 1 immediately before the front bolt 7 strikes the ammunition.

The cylindrical center section 13 of the front bolt 7 has a vertical bore 24 from top to bottom. The vertical bore 24 is sized to accept the cocking lever 3. Longitudinally, from under the extractor 21 and intersecting with the vertical bore 24 is a locking pin hole 25. The locking pin hole 25 has two diameters, the larger being toward the first caliber section 14 and the smaller being toward the vertical bore 24, thereby forming a shoulder 26 adjacent to the vertical bore 24. A locking pin 34 having a shoulder is inserted into the locking pin hole 25. The shoulder on the locking pin 34 mates with the shoulder in the locking pin hole 25 and the locking pin 34 protrudes into the vertical bore 24 yet is retained in the locking pin hole 25. A biasing spring 27 is inserted behind the locking pin 34 and the locking pin hole 25 is plugged underneath the extractor 21. The plugging can be accomplished by any conventional means such as threading the locking pin hole 25 and plugging with a mating screw 45. A similar locking pin hole 25, locking pin 34 biasing spring 27, and plug are incorporated into the end of the cylindrical center section 13 adjacent to the second caliber section 15. Transverse to the front bolt 7, through the front bolt 7 from one rail groove 12 to the other rail groove 12 are two assembly holes 28. The assembly holes 28 are located longitudinally along the front bolt 7 so that each one of the assembly holes 28 barely intersects the vertical bore 24, one assembly hole 28 on each side of the vertical bore 24. The side rails 8 are held in place by passing assembly pins 35 through rail assembly holes 29 in the side rails 8 and through the assembly holes 28. The rail assembly holes 29 are sized identical to the assembly holes 28 and are located in the side rails 8 to match the assembly holes 28. The assembly pins 35 are rod-like pins which slideably mate with the assembly holes 28. The center section of the assembly pins 35, all the way around the assembly pins 35, is partially removed so that when inserted in the assembly hole 28 the portion of the assembly pins 35 exposed in the vertical bore 24 has the same curvature as the vertical bore 24.

Figure 3:
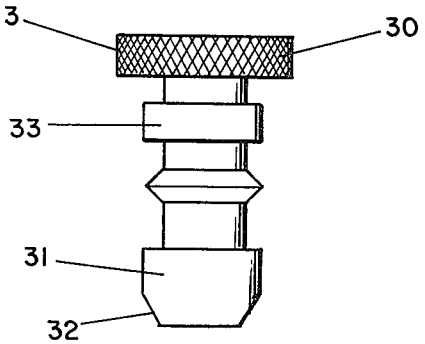
FIG. 3 a side view of the cocking lever.
Figure 4:
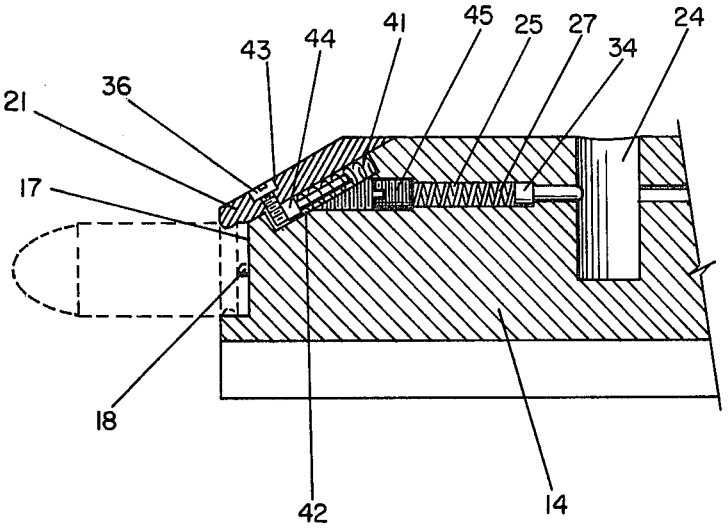
FIG. 4 is a cross sectional view of the first caliber section and center section of the front bolt.

The cocking lever 3 is shown in FIG. 3 to have a knurled knob 30 for grasping. The cocking lever 3 has generally a cylindrical shank 31, with a plurality of circular grooves and lands. The cocking lever 3 is sized so that the cylindrical shank 31 slideably, but with small clearance, can be inserted into the vertical bore 24. The cocking lever 3 thereby mates with the assembly pins 35 locking the assembly pins 35 in proper position. The cocking lever 3 is long enough to extend upward through a slot in the housing 11. The cylindrical shank 31 has two flats on its extremity to allow insertion of the cocking lever 3 in the vertical bore 24 past the locking pins 34. The locking pins 34 retain the cocking lever 3 in the vertical bore 24 but permit the cocking lever 3 to be positioned vertically. When fully raised, the cocking lever 3 protrudes through an enlarged portion of the slot in the housing, thus providing a safety feature. Depressing the cocking lever 3 lowers the appropriate safety land 33, permitting the bolt 4 to move forward and aft as in firing. The locking pins 34 engage the proper groove on the cylindrical shank 31 and retain the cocking lever 3 in the proper position.

The second caliber section 15 is functionally identical to the first caliber section 14, with only the necessary dimensions changed to reflect the alternate caliber desired. To change from one caliber to the other, all that is necessary is to remove the cocking lever 3, remove the assembly pins 35; the front bolt 7 is reversed and the assembly pins 35, cocking lever 3, replaced. Quite obviously, the second caliber section 15 could be identical to the first caliber section 14, thereby providing a spare. The second caliber section 15 could be of a different caliber than the first caliber section 14. However, the completely change weapon calibers, it is recognized that a replacement barrel would be needed, and probably an adapter for the second caliber ammunition magazine, in order for the weapon magazine receiver to accept the second caliber ammunition magazine. It is also recognized that when a second caliber configuration is used, the characteristics of the ammunition such as bullet mass and explosive power will be different and that the weapon will produce a less than optimum rate of fire.

I claim:

1. A bolt for use in firearms of the automatic or semi-automatic type, the bolt comprising a front bolt, a rear bolt and two side rails, wherein the front bolt is removeably but rigidly connected to the rear bolt by means of assembly pins and the side rails; and wherein the front bolt is cantilevered from the rear bolt by the side rails; and wherein the front bolt has a cylindrical center section, a first caliber section and a second caliber section; and wherein an ejector groove runs the length of the front bolt; and wherein a cocking lever is installed in the center section; and wherein the first caliber section has a firing face with a fixed firing pin, and the first caliber section has an extractor mechanism; and wherein the second caliber section has a firing face, and wherein the second caliber section has a fixed firing pin and an extractor mechanism; and wherein the front bolt may be dissassembled from the side rails, and the front bolt reversed end for end, and reassembled to the side rails.

2. The bolt of claim 1 wherein the first caliber section and the second caliber section are of the same caliber.

3. The bolt of claim 1 wherein the first caliber section and the second caliber section are of different calibers.

* * * * *